US008579277B2

(12) United States Patent
Okamoto et al.

(10) Patent No.: US 8,579,277 B2
(45) Date of Patent: Nov. 12, 2013

(54) DRIVE TRANSMISSION APPARATUS AND FEEDING APPARATUS

(75) Inventors: Takayuki Okamoto, Kawasaki (JP); Masaya Shimmachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 587 days.

(21) Appl. No.: 12/695,313

(22) Filed: Jan. 28, 2010

(65) Prior Publication Data

US 2010/0194030 A1 Aug. 5, 2010

(30) Foreign Application Priority Data

Jan. 30, 2009 (JP) ..... 2009-020229

(51) Int. Cl.
*B65H 3/06* (2006.01)

(52) U.S. Cl.
USPC ..... 271/109; 475/149; 74/352

(58) Field of Classification Search
USPC ..... 271/10.01, 117, 109; 475/149, 150; 74/352, 353, 354
See application file for complete search history.

(56) References Cited

U.S. PATENT DOCUMENTS

2007/0040322 A1 * 2/2007 Shimizu et al. ..... 271/117

FOREIGN PATENT DOCUMENTS

JP 2005-258039 * 9/2005
JP 2007-284214 11/2007

OTHER PUBLICATIONS

Machine translation of "Detailed Description" section of JP 2005-258039.*

* cited by examiner

*Primary Examiner* — Thomas Morrison
(74) *Attorney, Agent, or Firm* — Canon USA Inc IP Division

(57) ABSTRACT

A drive transmission apparatus includes a sun gear driven by a drive source, a planetary gear, a supporting member that supports the planetary gear capable of revolving around the sun gear in a rotatably engaged state with the sun gear, a driven gear that is engaged with the planetary gear when the planetary gear revolves and moves to an engagement position by the rotation of the sun gear in a first direction, and a rotational force providing unit that provides a rotational force to the driven gear to rotate the sun gear in a second direction opposite to the first direction via the planetary gear when the planetary gear is engaged with the driven gear. When the sun gear is rotated in the second direction by the drive source, the rotational force providing unit blocks the revolution of the planetary gear by rotating the planetary gear via the driven gear.

10 Claims, 11 Drawing Sheets

DRIVE TRANSMISSION APPARATUS AND FEEDING APPARATUS

BACKGROUND OF THE INVENTION

1. Field of the Invention

The present invention relates to a drive transmission apparatus used in an image forming apparatus represented by a printer, copying machine, facsimile, or the like, an image reading apparatus, or a sheet feeding apparatus of auto document feeder (ADF). Further, the present invention relates to a sheet feeding apparatus provided with a drive transmission apparatus.

2. Description of the Related Art

In a conventional sheet feeding apparatus that separates and conveys loaded sheets, a drive transmission apparatus which includes a planetary gear mechanism (also referred to as a pendulum mechanism) has been used to allow a variety of operations a single drive source.

The planetary gear mechanism includes a sun gear that rotates around a fixed shaft and a planetary gear supported by an arm (also referred to as a pendulum) so that the planetary gear can revolve around the sun gear while being engaged with the sun gear. The arm is supported rotatably around a rotation center of the sun gear.

Since a rotational load is imposed on the arm by a friction member or the like from the planetary gear, when the sun gear is rotated by the drive source, the arm rotates before the planetary gear rotates. Thus, the planetary gear revolves around the sun gear and when, as a result, the planetary gear is engaged with another driven gear and rotational movement of the arm is blocked, the planetary gear starts to rotate. Then, the driving is transmitted from the driven gear further to another gear train.

If the sun gear is rotated in an opposite direction by the drive source, the arm rotationally moves in a direction that moves the planetary gear away from the driven gear to separate the planetary gear from the driven gear, so that drive transmission is released.

To transmit a reverse rotation to a drive train downstream from the driven gear while maintaining an engaged state of the planetary gear and the driven gear, a method for forcibly locking the arm (see, for example, Japanese Patent Application Laid-Open No. 2007-284214) by adding another driving member such as a solenoid has frequently been used.

However, the above method for forcibly locking the arm by adding another driving member such as a solenoid as discussed in Japanese Patent Application Laid-Open No. 2007-284214 has a problem that manufacturing costs increase with addition of expensive parts, which is to be addressed.

SUMMARY OF THE INVENTION

The present invention is directed to a drive transmission apparatus capable of performing drive transmission, drive release, and reverse rotation drive transmission for a fixed time using a planetary gear without using expensive parts and a feeding apparatus provided therewith.

According to an aspect of the present invention, a drive transmission apparatus includes a sun gear that is driven by a drive source, a planetary gear, a supporting member configured to support the planetary gear capable of revolving around the sun gear in a rotatably engaged state with the sun gear, a load unit configured to provide a load to a rotation of the supporting member, a driven gear engaging with the planetary gear when the planetary gear revolves and moves to an engagement position due to the rotation of the sun gear in a first direction, and a rotational force providing unit configured to provide a rotational force to the driven gear to rotate the sun gear in a second direction opposite to the first direction via the planetary gear when the planetary gear is engaged with the driven gear, wherein when the sun gear is rotated in the second direction by the drive source, the rotational force providing unit blocks the revolution of the planetary gear by rotating the planetary gear via the driven gear.

According to the present invention, a drive transmission apparatus capable of performing drive release and reverse rotation drive transmission for a fixed time using a drive source and a planetary gear mechanism without using expensive parts and a feeding apparatus provided therewith can be provided.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. It is noted that a material, a shape, and a relative position of components described in the following exemplary embodiments may be arbitrarily modified according to a configuration or various conditions of an apparatus to which the present invention is applied.

In a first exemplary embodiment, a drive transmission mechanism to which the present invention is applied will be described.

Figure 1A:
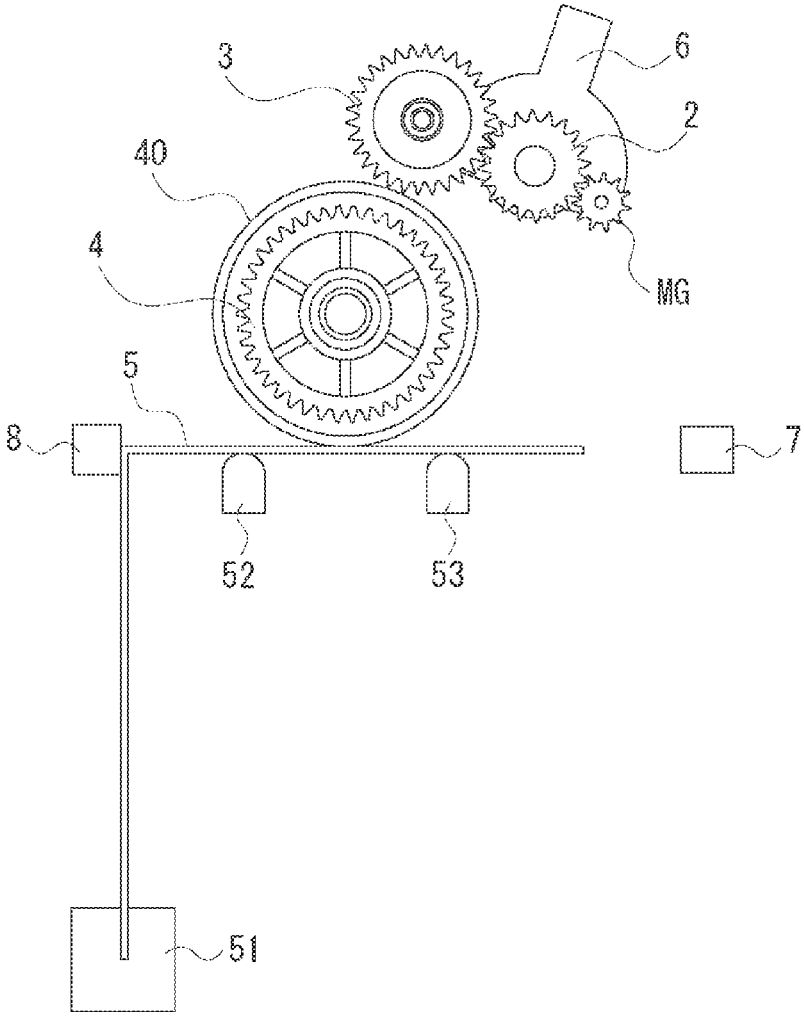
FIGS. 1A and 1B illustrate side views of a planetary gear mechanism in an initial state according to a first exemplary embodiment.
Figure 1B:
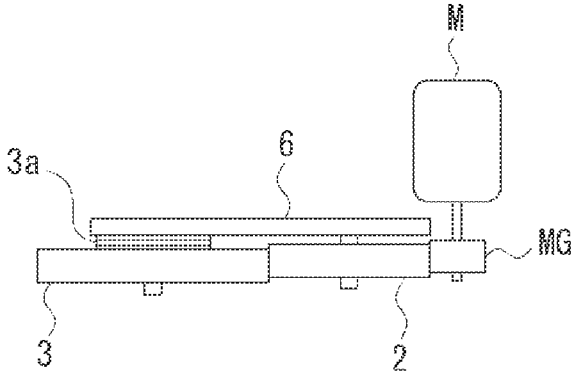
Figure 2:
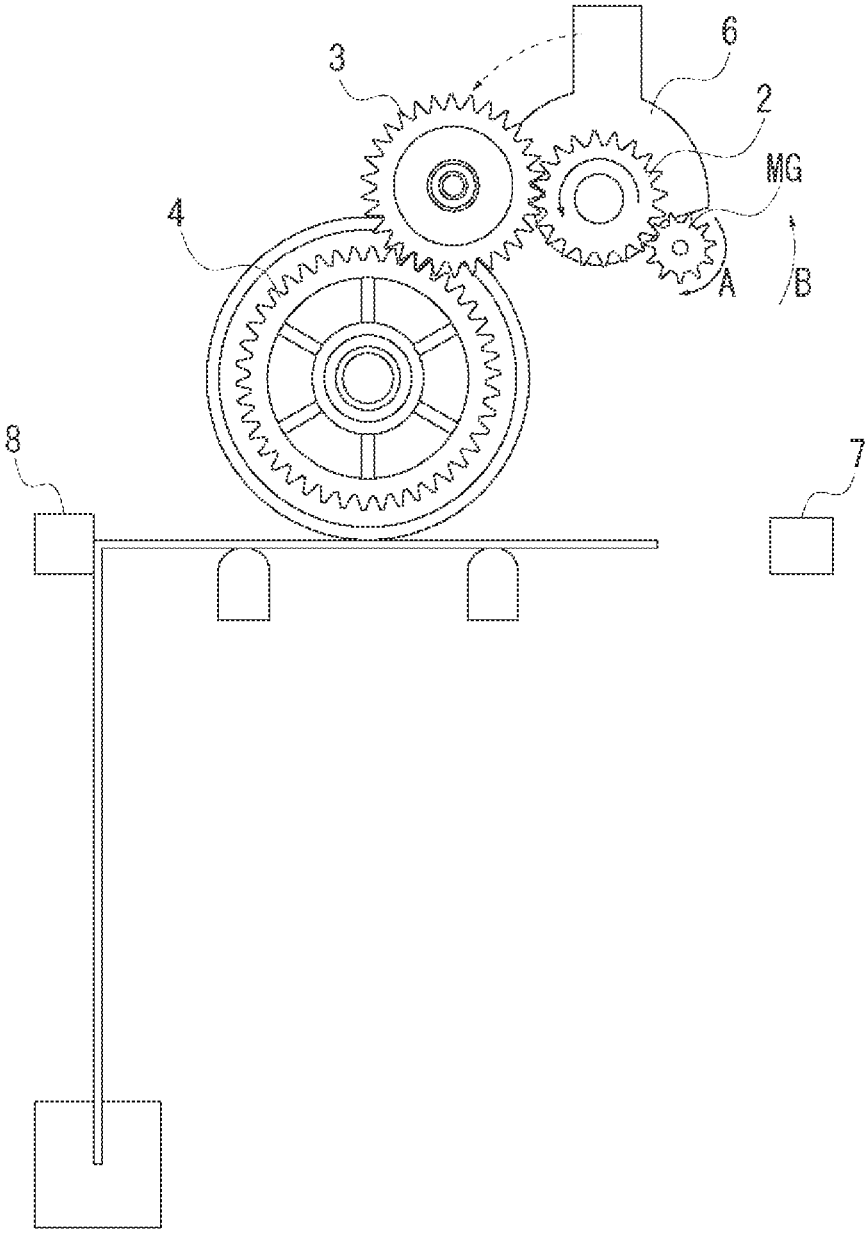
FIG. 2 illustrates a side view of a planetary gear and a driven gear of the planetary gear mechanism immediately after being engaged.
Figure 3:
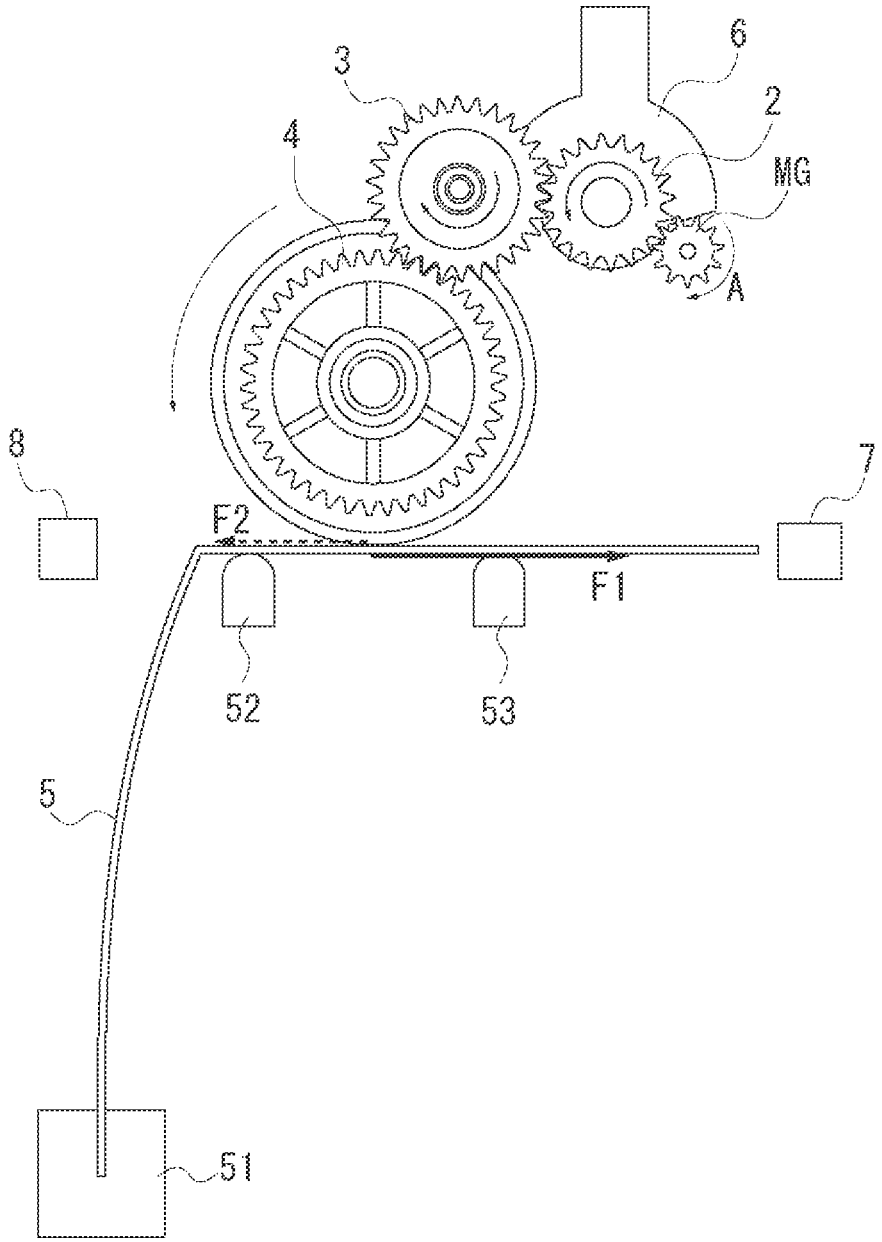
FIG. 3 illustrates a side view of the planetary gear and the driven gear which are engaged in a driving state.
Figure 4:
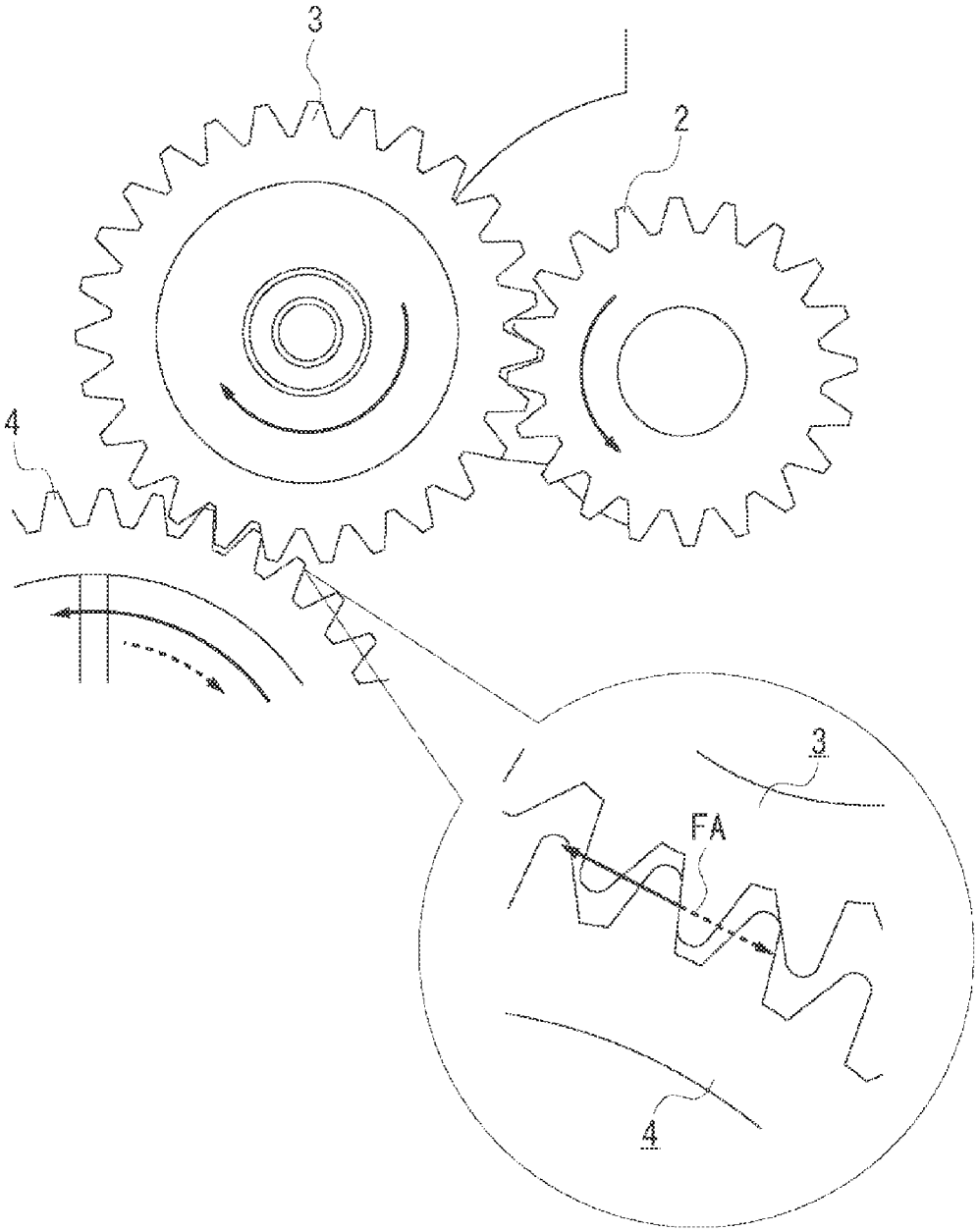
FIG. 4 illustrates a detail view of the planetary gear mechanism in a normal rotation state to which the present invention is applied.
Figure 5:
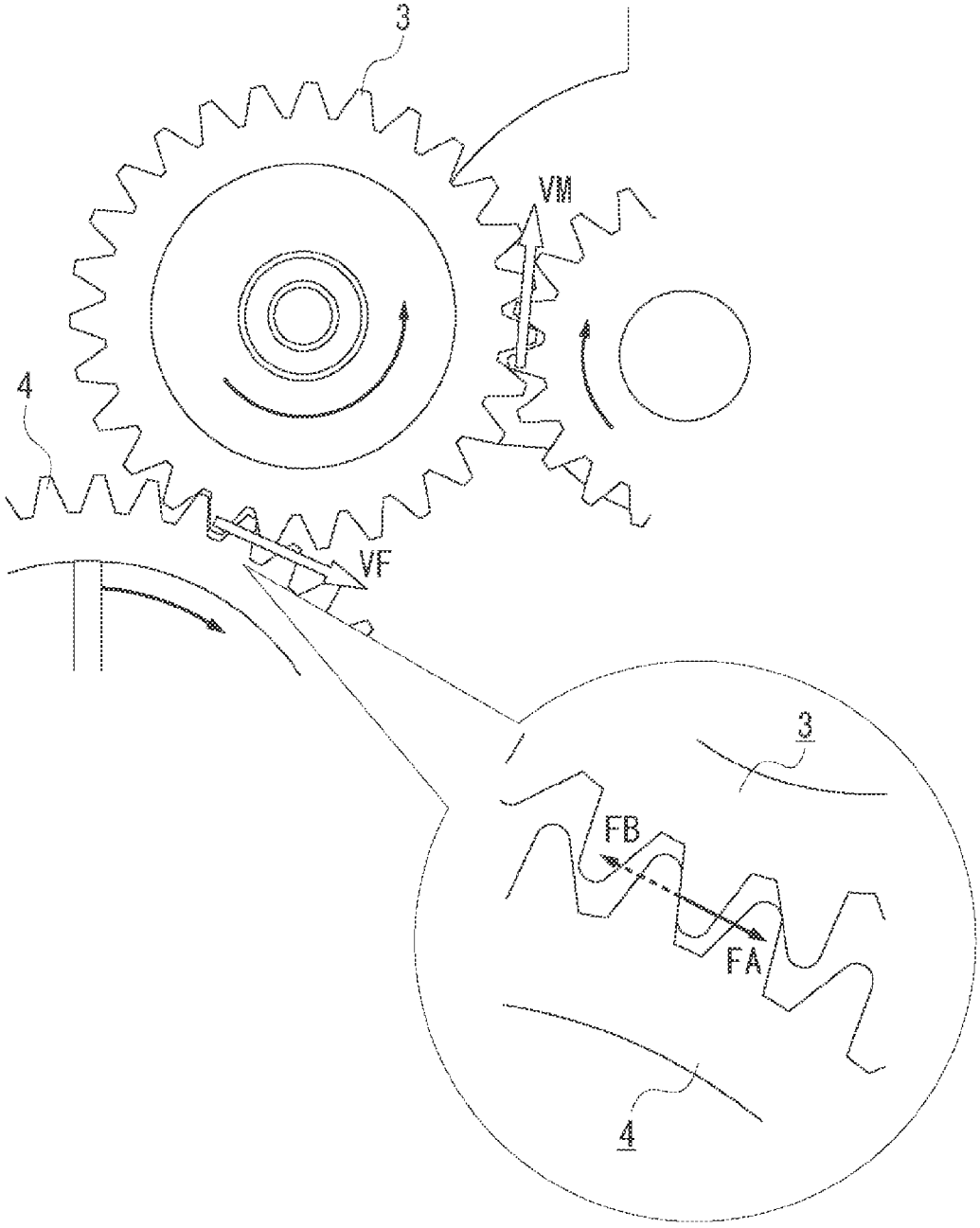
FIG. 5 illustrates a detail view of the planetary gear mechanism in a reverse rotation state to which the present invention is applied.

FIG. 1A illustrates a side view of the drive transmission mechanism in an initial state before driving according to the first exemplary embodiment of the present invention. FIG. 1B is a plan view of principal parts of the drive transmission mechanism. FIG. 2 illustrates a side view of a planetary gear and a driven gear of the drive transmission mechanism according to the first exemplary embodiment immediately after being engaged. FIG. 3 illustrates a side view of the planetary gear and the driven gear of the drive transmission mechanism in a driving state after the planetary gear and the driven gear are engaged according to the first exemplary embodiment. FIG. 4 illustrates a detail view of the drive transmission mechanism in a normal rotation state to which the present invention is applied. FIG. 5 illustrates a detail view of the drive transmission mechanism in a reverse rotation state to which the present invention is applied.

First, a configuration of the drive transmission mechanism will be described. As illustrated in FIG. 1, the drive transmission mechanism is driven by an output gear MG fixed to an output shaft of a motor M that serves as a drive source. The drive transmission mechanism is provided with a sun gear 2 engaged with the output gear MG and a planetary gear 3 that revolves around the sun gear 2 while being engaged with the sun gear 2. The planetary gear 3 is rotatably supported by a supporting member 6 which is rotatably supported around a rotation shaft of the sun gear.

Further, a driven gear 4 that is engaged with the planetary gear when the planetary gear 3 rotationally moves to a predetermined engagement position and a plate spring 5 provided so as to be always in slidingly contact with a flange unit 40 integrally formed with the driven gear 4 are provided.

The plate spring 5 which is an elastic member is formed in an L shape and one end thereof is cantileveredly supported by a fixing member 51 of a main body of the apparatus. Guide members 52 and 53 guide the plate spring 5 so that the plate spring 5 is pressed onto the flange unit 40. Abutting members 7 and 8 specify a movement range of the plate spring member.

A compression spring 3*a* is provided between the planetary gear 3 and the supporting member 6. The compression spring 3*a* serves as a loading unit that imposes a rotational load to the planetary gear 3 when the planetary gear 3 rotates by being pressed onto the planetary gear 3 and the supporting member 6.

As illustrated in FIG. 2, a driving direction of a drive train when the output gear MG rotates clockwise is defined as a normal rotation direction A and the driving direction when the output gear MG rotates counterclockwise is defined as a reverse rotation direction B. When the output gear MG starts normal rotation driving, the sun gear 2 rotates in a first direction, which is the counterclockwise direction in FIG. 2. The planetary gear 3 revolves around the sun gear in the first direction to move to an engagement position where the planetary gear 3 is engaged with the driven gear 4 to transmit the driving to the driven gear 4.

As illustrated in FIG. 3, when the driven gear 4 is rotated counterclockwise, the plate spring 5 receives a frictional force F1 from the flange unit 40 of the driven gear 4 to undergo an elastic deformation and moves in a horizontal direction so that a free end thereof comes into contact with an abutting member 7. At this point, a restoring force of the plate spring 5 acts on the flange unit 40 of the driven gear 4 as a frictional force F2.

Next, a situation when the output gear MG is switched from the normal rotation drive to reverse rotation drive and the sun gear 2 rotates in a second direction, which is the opposite direction of the first direction, will be described. When the plate spring 5 undergoes an elastic deformation to be sufficiently charged due to the normal direction driving of the output gear MG, as illustrated in FIG. 3, the flange of the driven gear 4 receives a force of the frictional force F2 from the plate spring 5. The frictional force F2 acts to rotate the driven gear 4 clockwise. In other words, the plate spring 5 acts as a rotational force providing unit that provides a rotational force to the driven gear 4. The frictional force F2 acts, as illustrated in FIG. 4, as a force FA which acts on the planetary gear 3 via the driven gear 4.

Conventionally, when the reverse rotation drive is performed after the driven gear 4 is engaged with the planetary gear 3 in the normal direction driving in a planetary gear apparatus, the rotational force of the sun gear 2 in the second direction is first transmitted to the planetary gear 3. However, the compression spring 3*a* provided between the planetary gear 3 and the supporting member 6 blocks the rotation of the planetary gear 3 and the planetary gear 3 revolves around the sun gear 2 clockwise integrally with the supporting member 6. As a result, the planetary gear 3 moves away from the driven gear 4.

However, in a planetary gear apparatus according to the present exemplary embodiment, when a motor starts rotating in the reverse direction after rotated in the normal direction, a force generated by the plate spring 5 always acts as the force FA acting on the planetary gear 3 via the driven gear 4.

A force necessary to rotate the planetary gear 3 by overcoming the frictional force caused by the compression spring 3*a* between the planetary gear 3 and the supporting member 6 is defined as FB. The force FA when the plate spring 5 is elastically deformed such that a distance between the end of the plate spring 5 and the abutting member 7 becomes a predetermined value or less is set to be larger than the force FB.

When the reverse rotation drive starts in a state of FA>FB due to the normal rotation of the motor, as illustrated in FIG. 5, if the sun gear 2 minutely rotates clockwise, the planetary gear 3 also rotates counterclockwise by receiving a force from the driven gear 4. In other words, while driving from the sun gear 2 is not transmitted to the planetary gear 3, the planetary gear 3 rotates according to the rotation of the sun gear 2, so that the planetary gear 3 is not immediately disengaged from the driven gear 4. Thus, the planetary gear 3 makes a following rotation according to the movement of the sun gear 2.

If the reverse rotation drive continues as it is, charges of the plate spring 5 are discharged along with the clockwise rotation of the driven gear 4 and the force FA acting on the planetary gear 3 from the plate spring 5 decreases. When FA<FB is satisfied, the driven gear 4 can no longer rotate the planetary gear 3. Thus, if the sun gear 2 is driven in the reverse rotation direction at that point, the planetary gear 3 does not rotate due to the frictional force of the compression spring 3*a* and the planetary gear 3 and the supporting member 6 integrally rotates around the rotation shaft of the sun gear 2. As a result, the planetary gear 3 moves away from the driven gear 4, and the driving is cut.

It is desirable that the plate spring 5 adheres to the fixing member 51 while the plate spring is in an elastically deformed state so that FA>FB is already satisfied even in a state before normal rotation driving in which the plate spring 5 is in contact with the abutting member 8. In such a configuration, the plate spring 5 can provide to the planetary gear 3 a rotational force capable of blocking the revolution of the planetary gear 3 even if the sun gear 2 is rotated in the second direction in a state before the plate spring 5 is elastically deformed by the normal rotation of the motor.

In such a configuration, if the motor is driven in the normal rotation direction, the elastic deformation of the plate spring 5 further increases. Thus, the rotational force that can be provided to the driven gear 4 increases. Then, when the motor is driven in the reverse rotation direction, the driven gear 4 can be driven in the opposite direction with stability until the plate spring 5 comes into contact with the abutting member 8.

Figure 6:
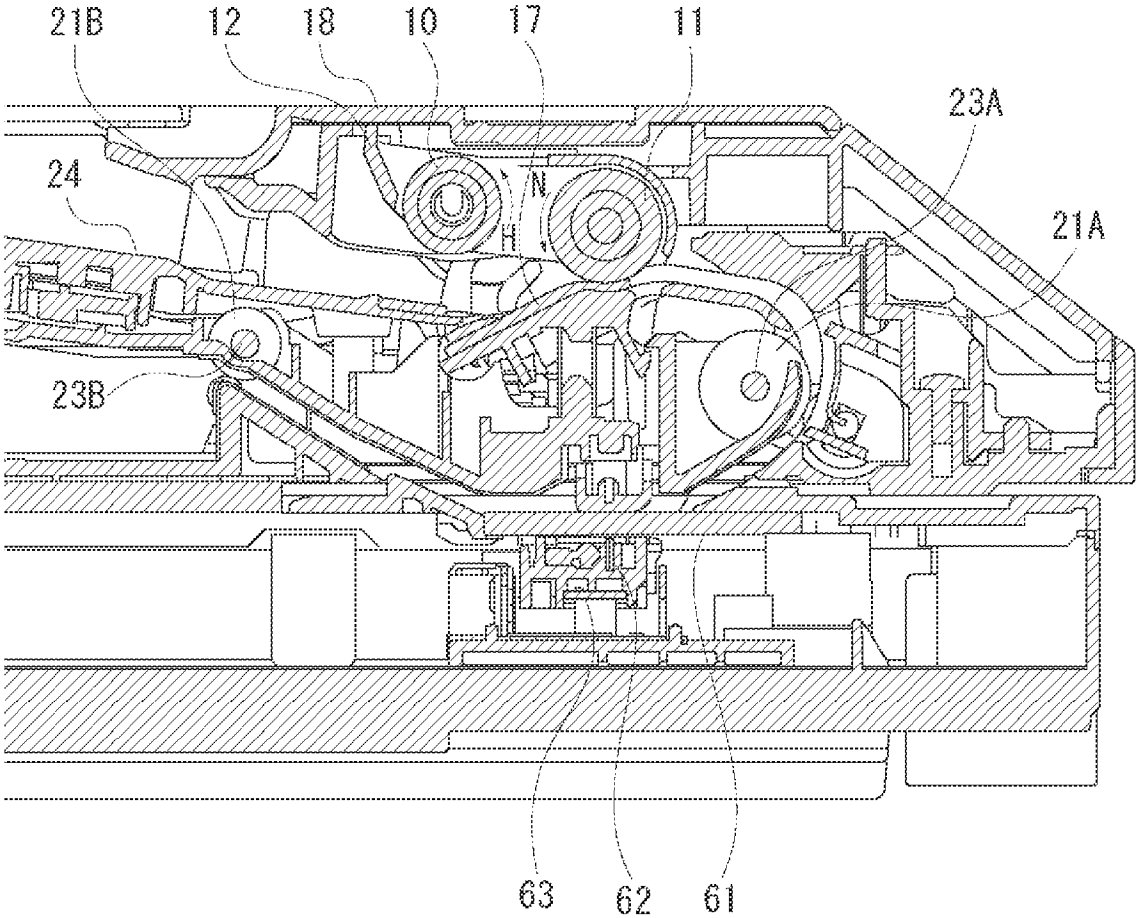
FIG. 6 illustrates a sectional view of a feeding apparatus which includes the planetary gear mechanism according to a second exemplary embodiment.
Figure 7:
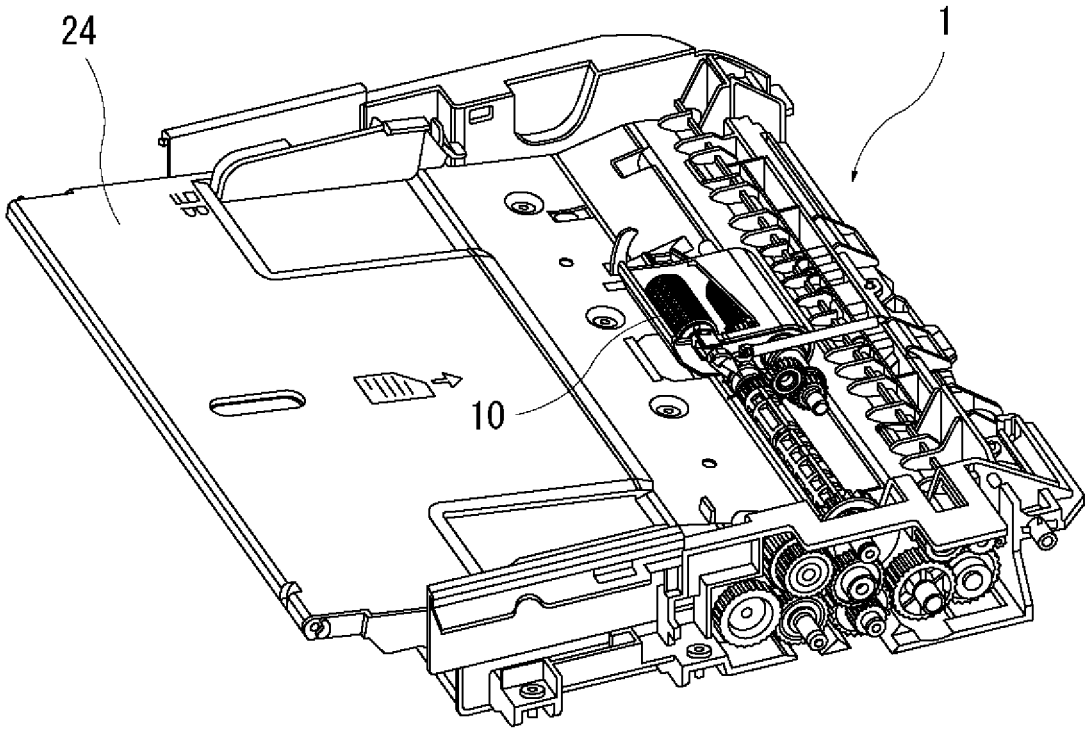
FIG. 7 illustrates a perspective view of a sheet feeding unit in the feeding apparatus according to the second exemplary embodiment.
Figure 8:
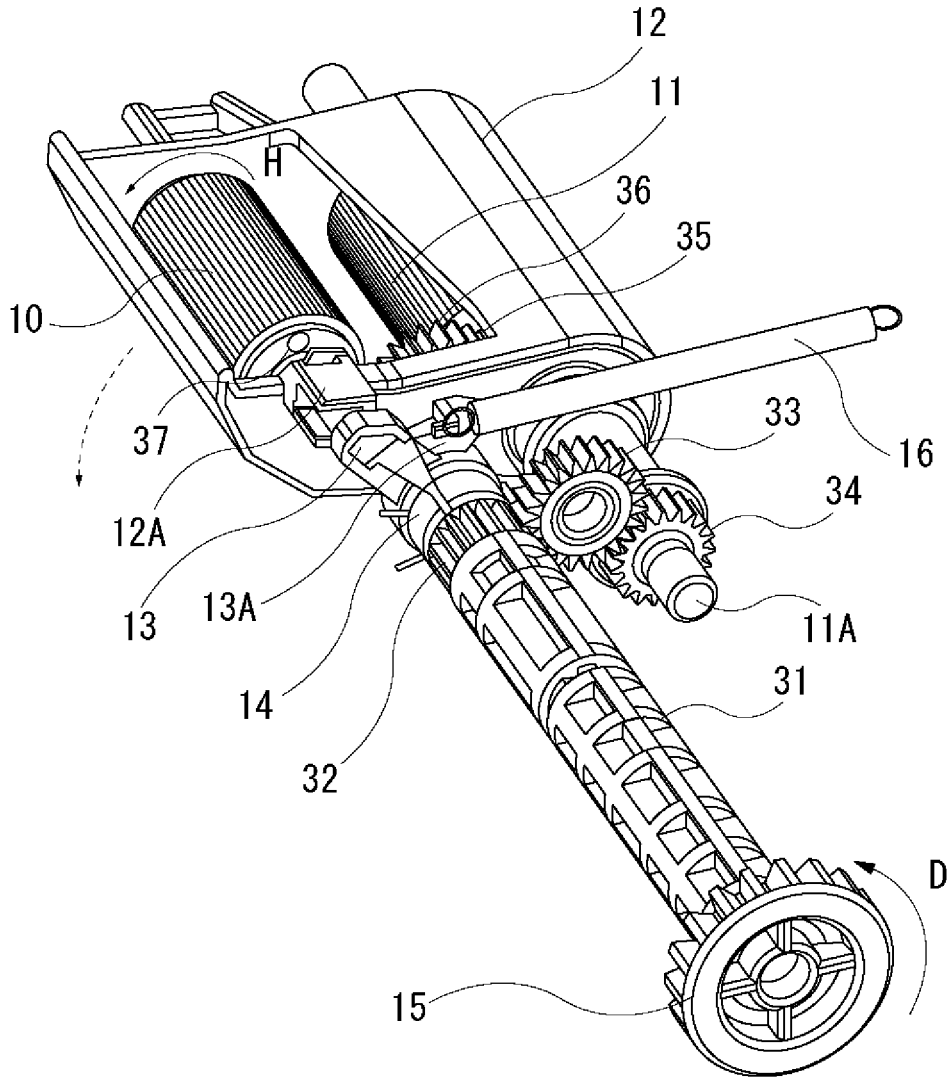
FIG. 8 illustrates a perspective view of a portion of the sheet feeding unit in the feeding apparatus according to the second exemplary embodiment.
Figure 9:
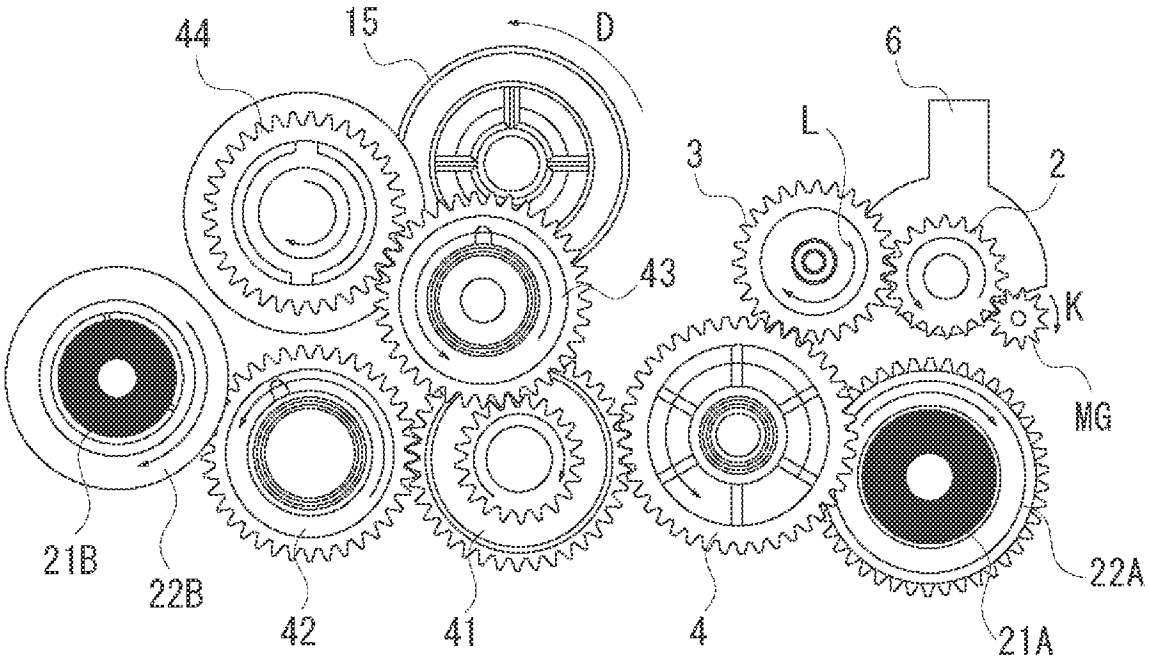
FIG. 9 illustrates a side view of a drive train in the feeding apparatus according to the second exemplary embodiment.
Figure 10:
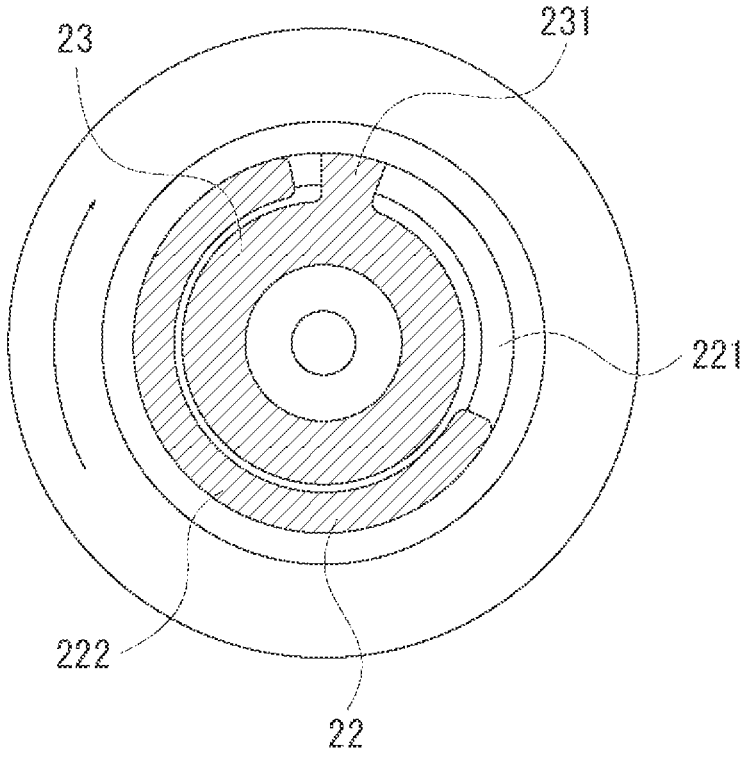
FIG. 10 illustrates a sectional view of a differential mechanism in the feeding apparatus according to the second exemplary embodiment.

Next, a feeding apparatus which includes a planetary gear as a second exemplary embodiment will be described. FIG. 6 illustrates a sectional view of the feeding apparatus. FIG. 7 illustrates a perspective view of a sheet feeding unit of the feeding apparatus. FIG. 8 illustrates a perspective view of a portion of the feeding apparatus. FIG. 9 illustrates a side view of a drive gear train of the feeding apparatus. FIG. 10 illustrates a sectional view of a differential mechanism in the drive gear train. The present exemplary embodiment is a feeding apparatus provided in an image reading apparatus which includes an image reading unit.

First, a configuration of a feeding apparatus 1 will be described. As illustrated in FIGS. 6 to 8, the feeding apparatus 1 includes a feeding tray 24 for loading sheets (not illustrated), such as recording paper and documents, and a pickup roller 10 for feeding a loaded sheet to a separation unit.

The separation unit includes a separation roller 11 for conveying the fed sheet which is loaded on the top and a separation pad 17 for separating each sheet by blocking the second and subsequent sheets from advancing.

A pickup roller case 12 holds the pickup roller 10. The pickup roller case 12 is rotatably supported by a rotation shaft 11A of the separation roller 11 and supports the pickup roller 10 so that the pickup roller 10 can come into contact with loaded sheets or separate from loaded sheets.

A separation gear 15 is a rotating member for transmitting driving to the pickup roller 10 and the separation roller 11 by receiving the driving from a drive gear train described below. The rotation transmitted to the separation gear 15 is transmitted to gears 32, 33, and 34 via a separation gear shaft 31 and transmitted to the separation roller 11 fixed to the same shaft as the gear 33. Further, the rotation transmitted to a gear 36 from another gear 35 fixed to the same shaft as the separation roller 11 is further transmitted to an input gear 37 of the pickup roller 10 so that the pickup roller 10 is rotated.

A depressing arm 13 which is rotatably supported by the separation gear shaft 31 includes an engagement unit at an edge thereof which is engaged with an engagement unit 12A of the pickup roller case 12. The rotation of the separation gear shaft 31 is transmitted to the depressing arm 13 via a one-way clutch spring 14. By rotationally moving the depressing arm 13 counterclockwise in FIG. 8, the pickup roller case 12 rotates around the separation roller shaft 11A and the pickup roller 10 is pressed down to come into contact with loaded sheets.

A tension spring 16 has one end fixed to the main body of the apparatus and the other end fixed to a lever 13A of the depressing arm 13. The tension spring 16 urges the depressing arm 13 in such a way that the depressing arm 13 rotationally moves clockwise.

The depressing arm 13 and the tension spring 16 constitute a movement unit that causes the pickup roller 10 to come into contact with or separate from loaded sheets.

In an initial state before driving, the pickup roller case 12 is on standby at a maximally raised position by the depressing arm 13 which is rotationally moved clockwise by an urging force of the tension spring 16. The position is determined as a position where the pickup roller case 12 abuts against an access cover 18.

If the separation gear 15 is rotated (normal rotation) in a D direction in FIG. 8 by the drive gear train described below, the depressing arm 13 presses down the pickup roller case 12 in a sheet contact direction. At the same time, the rotation of the separation gear 15 is transmitted to the gears 32, 33, 34, 35, 36, and 37, and is further transmitted to the pickup roller 10 and the separation roller 11. The pickup roller 10 comes into contact with loaded sheets and rotates to feed sheets to the separation roller 11. The fed sheets are separated and conveyed sheet by sheet by the separation roller 11 and the separation pad 17. The sheets are conveyed by conveyance rollers 21A and 21B further downstream.

An image reading unit is provided on a conveyance path that guides sheets from the conveyance roller 21A to the conveyance roller 21B. The image reading unit reads an original image formed on a sheet and converts the read image into an electric signal. The image reading unit includes transparent glass 61 that guides an image surface of a document, a board 63 provided with charge coupled devices (CCDs), and a rod lens 62 that forms an image on the sheet guided by the glass 61 on the CCDs of the board 63.

Next, the drive gear train upstream from the separation gear 15 will be described. In FIG. 9, the output gear MG is fixed to an output shaft of a motor and the rotation of the output gear MG is transmitted to the sun gear 2, the planetary gear 3, and the driven gear 4.

Similar to the first exemplary embodiment, the planetary gear 3 is rotatably supported by the supporting member 6 which is rotatably supported around a rotation shaft of the sun gear. Further, similar to the first exemplary embodiment, the compression spring 3*a* is provided between the planetary gear 3 and the supporting member 6 to impose a rotational load to the planetary gear 3 when the planetary gear 3 rotates.

The rotation of the drive gear 4 is transmitted to a conveyance roller gear 22A. At the same time, the rotation of the drive gear 4 is transmitted to a downstream conveyance roller gear 22B via gears 41 and 42. The rotation of the drive gear 4 is further transmitted to the separation gear 15 via gears 43 and 44.

Similar to the first exemplary embodiment, when the output gear MG rotates in a K direction in FIG. 9, the planetary gear 3 is engaged with the driven gear 4 while rotating in an L direction to transmit the rotation and the separation gear 15 is rotated in the D direction via the above described gear train.

The tension spring 16 has one end fixed to the access cover 18 and the other end fixed to the depressing arm 13 and always applies an urging force to the depressing arm 13 in a sheet separating direction of the pickup roller 10. The urging force of the tension spring 16 also serves to rotate the separation gear 15 in the opposite direction of the D direction via the one-way clutch spring 14 mounted on the separation gear shaft 31.

The urging force of the tension spring 16 that attempts to rotate the separation gear 15 in the opposite direction of the D direction becomes a force that rotates the planetary gear 3 in the opposite direction of the L direction via the drive gear train.

A force of the tension spring 16 that rotates the planetary gear 3 in the opposite direction of the L direction is defined as FA. A force necessary to rotate the planetary gear 3 by overcoming the urging force of the compression spring 3*a* between the planetary gear 3 and the supporting member 6 is defined as FB. By setting the spring force of the tension spring 16 so that FA>FB is satisfied, an operation of the planetary gear mechanism similar to that of the first exemplary embodiment is achieved.

Next, a feeding operation of sheets will be described. If a motor is driven in the normal rotation direction, the output gear MG of the motor rotates in the K direction in FIG. 9 and the rotation is transmitted to the sun gear 2. The planetary gear 3 that is engaged with the sun gear 2 revolves around the sun gear 2 together with the supporting member 6 without being rotated by a rotational load of the compression spring 3*a* and moves to a position where the planetary gear 3 is engaged with the driven gear 4. When the planetary gear 3 is engaged with the driven gear 4, the planetary gear 3 starts to rotate in the L direction and the rotation is transmitted via the gears 41, 43, and 44 to rotate the separation gear 15 in the D direction. The rotation of the separation gear 15 is transmitted to the separation roller 11 via the gears 32, 33, and 34 and further transmitted to the pickup roller 10 via the gears 35, 36, and 37.

At the same time, the rotation of the separation gear 15 is transmitted to the depressing arm 13 via the one-way clutch spring 14. The depressing arm 13 rotationally moves counterclockwise in FIG. 8 against the urging force of the tension spring 16. The pickup roller case 12 rotationally moves around the separation roller shaft 11A due to the depressing arm 13 and presses down the pickup roller 10 to come into contact with loaded sheets.

Then, the pickup roller 10 rotates in an H direction to feed sheets loaded on the feeding tray 24. Only one sheet of fed sheets is separated by the separation roller 11 and the separation pad 17 which rotate in an N direction and is conveyed downstream.

The rotation of the driven gear 4 is transmitted to the conveyance roller 21A via the gear 22A and similarly transmitted to the conveyance roller 21B via the gears 41, 42, and 22B.

The sheet that passes through the separation unit is further conveyed downstream by the rotating conveyance rollers 21A and 21B.

Next, when the motor is driven in the reverse rotation direction, the output gear MG rotates in the opposite direction of K direction and the rotation is transmitted to the sun gear 2.

On the other hand, the urging force of the tension spring 16 extended by rotational movement of the depressing arm 13 during feeding serves as a force to rotate the separation gear 15 in the opposite direction of the D direction via the one-way clutch spring 14. The rotational force thereof is transmitted to the driven gear 4 via the gears 44, 43, and 41 to exert the force FA for rotating the sun gear 2 in the opposite direction of the L direction on the planetary gear 3 from the driven gear 4.

The force necessary to rotate the planetary gear 3 by overcoming the frictional force caused by the compression spring 3*a* between the planetary gear 3 and the supporting member 6 is defined as FB. As described in the first exemplary embodiment using FIG. 4, FA is set larger than FB. Thus, if the sun gear 2 minutely rotates in the reverse rotation direction when the reverse rotation drive starts, the planetary gear 3 also rotates by receiving the force FA from the driven gear 4, so that the planetary gear 3 moves together with the movement of the sun gear 2. Therefore, the rotation of the sun gear 2 is not transmitted to the planetary gear and instead, the planetary gear 3 moves together with the reverse rotation drive of the sun gear 2, so that the planetary gear 3 is not immediately disengaged from the driven gear 4.

If the reverse rotation drive continues as it is, the depressing arm 13 rotates in the reverse rotation direction according to the reverse rotation drive and the pickup roller 10 is separated from sheets and raised. Further, a charge of the tension spring 16 is released and the force FA which is generated by the tension spring 16 and acts on the planetary gear 3 decreases according to the reverse rotation drive. Then, when FA<FB is satisfied, the driven gear 4 can no longer rotate the planetary gear 3. Thus, the reverse rotation drive transmitted from the sun gear 2 to the planetary gear 3 is transmitted from the planetary gear 3 to the supporting member 6 via the compression spring 3*a*. The supporting member 6 rotationally moves in the reverse rotation direction, and the planetary gear 3 moves away from the driven gear 4, so that transmission of the driving is cut off.

A differential unit is provided between the conveyance roller gears 22A and 22B and the conveyance rollers 21A and 21B respectively. Each differential unit has the same structure illustrated in FIG. 10. As illustrated in FIG. 10, the differential unit includes a plurality of transmission members such as a conveyance roller shaft 23 and the conveyance roller gear 22. An arm-shaped portion 231 is formed in the conveyance roller shaft 23 to which the conveyance roller 21A or 21B is fixed.

The conveyance roller gear 22A or 22B is rotatably supported by the conveyance roller shaft 23 by allowing the conveyance roller shaft 23 to pass through a shaft hole 223 thereof. The conveyance roller gear 22A or 22B includes a cylindrical hub 222 extending in a rotation shaft direction and a portion of the hub 222 is provided with a notched portion 221. The arm-shaped portion 231 is engaged with the notched portion 221 of the hub 222 with an allowance. More specifically, the gear 22 is freely rotatable by a predetermined angle for the conveyance roller shaft 23 within a range in which the arm-shaped portion 231 does not come into contact with an edge of the notched portion 221.

When the motor is driven in the reverse rotation direction, the counter-rotation of the separation gear 15 by the tension spring 16 is transmitted to the gear 22A and similarly transmitted to the gear 22B via the gears 41 and 42. However, by providing the differential mechanism, the counter-rotation of the gear 22A is not transmitted to the conveyance roller 21A and the rotation of the gear 22B is not transmitted to the conveyance roller 21B while the pickup roller 10 is separated from sheets. Therefore, high-load torque held by the conveyance rollers 21A and 21B is not transmitted to the drive gear train for an amount of rotation of the notched portion. Consequently, a loss of an urging force generated by the tension spring 16 in transmission to the planetary gear 3 can be reduced.

In the feeding apparatus according to the present exemplary embodiment, an impact sound created when the pickup roller case 12 is raised and brought into contact with the abutting member to become a standby state can be avoided by controlling the speed of the motor.

A circumferential speed of the planetary gear in the engagement unit of the driven gear 4 and the planetary gear 3 when the planetary gear 3 is rotated by a differential force of FA and FB (FA-FB) during counter-rotation of the motor is defined as VF. Further, a circumferential speed of the sun gear in the engagement unit of the sun gear and the planetary gear when the motor rotates the planetary gear 3 in the opposite direction of the rotation direction during feeding is defined as VM. If VM is faster than VF, the sun gear 2 rotates faster than the planetary gear 3 which is moved together with the sun gear 2 in the reverse rotation direction, so that driving is transmitted to the planetary gear 3, and the driving is immediately cut off. Therefore, in the present exemplary embodiment, VM is set to be slower than VF, so that the driving speed in the reverse rotation drive can be controlled.

Figure 11:
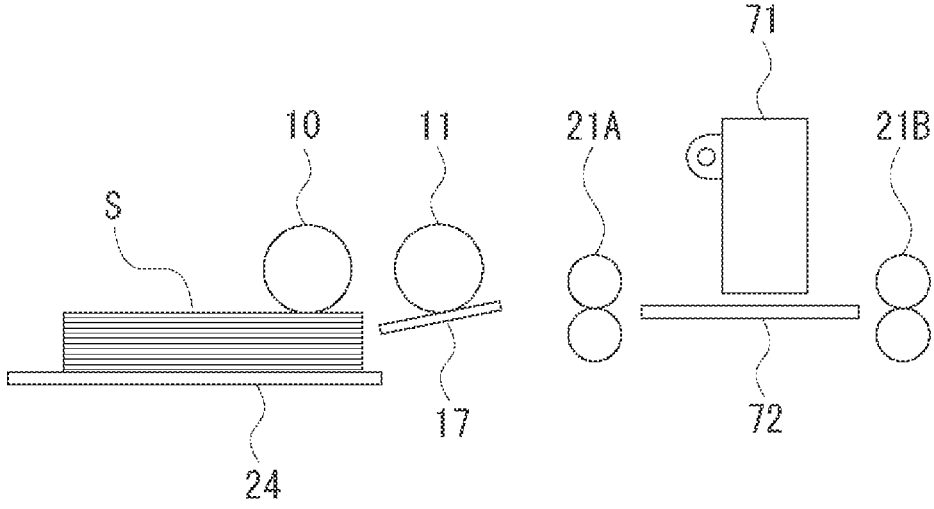
FIG. 11 illustrates an explanatory view of principal parts of an image forming apparatus according to a third exemplary embodiment.

FIG. 11 illustrates a third exemplary embodiment. The third exemplary embodiment is an example in which a feeding apparatus according to the second exemplary embodiment is provided in an image forming apparatus.

Referring to FIG. 11, the feeding apparatus of the present exemplary embodiment includes the feeding tray 24 for loading sheets S for recording, the pickup roller 10, the separation roller 11, the separation pad 17, and the conveyance rollers 21A and 21B. The configuration of the feeding apparatus is different only in arrangement and the drive source and drive transmission apparatus have precisely the same configuration as in the second exemplary embodiment.

An image forming unit 71 forms an image on a sheet and is, in the present exemplary embodiment, an ink jet recording head that forms an image by discharging ink.

A platen 72 guides a sheet conveyed by the conveyance roller 21A to a position facing to the recording head 71. The platen 72 serves to maintain the recording surface of the sheets S flat and to maintain an ink discharging port of the recording head 71 and the recording surface of the sheets S at a predetermined distance.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-020229 filed Jan. 30, 2009, which is hereby incorporated by reference herein in its entirety.

What is claimed is:

1. A drive transmission apparatus, comprising:

a first gear that is driven by a drive source, wherein the first gear is rotated in a first direction and a second direction opposite to the first direction by the drive source;

a second gear;

a supporting member configured to support the second gear capable of revolving around the first gear in a rotatably engaged state with the first gear;

a driven gear engaging with the second gear when the second gear revolves to an engagement position due to the rotation of the first gear in the first direction; and a rotational force providing unit configured to provide a rotational force to the driven gear to rotate the first gear in the second direction via the second gear when the second gear is engaged with the driven gear, wherein when the first gear is rotated in the second direction by the drive source, the second gear receives a rotational force via the driven gear and the rotational force prevents the second gear from revolving around the first gear.

2. The drive transmission apparatus according to claim 1, wherein the rotational force providing unit includes an elastic member and blocks the revolution of the second gear by rotating the second gear with a restoring force from an elastic deformation of the elastic member via the driven gear.

3. The drive transmission apparatus according to claim 2, wherein the elastic member increases the rotational force that can be provided, by increasing the elastic deformation by the driven gear caused by the rotation of the first gear in the first direction transmitted via the second gear, and is provided with the restoring force capable of blocking the revolution of the second gear even before the elastic deformation is increased.

4. The drive transmission apparatus according to claim 1, wherein a force FA that is acted on the second gear by the rotational force providing unit via the driven gear becomes larger than a force FB that is necessary to rotate the second gear.

5. The drive transmission apparatus according to claim 1, further comprising a compression spring provided between the second gear and the supporting member and the compression spring imposes a rotational load when the second gear is rotated relative to the supporting member by bringing the compression spring into contact with the second gear and the supporting member by pressure.

6. A feeding apparatus, comprising:

the drive transmission apparatus according to claim 1;

a pickup roller configured to be supported so as to allow the pickup roller to come into contact with or to separate from loaded sheets;

a rotating member configured to rotate by receiving transmission of drive from the driven gear when the first gear rotates in the first direction; and a movement unit configured to move the pickup roller to a position where the pickup roller comes into contact with the sheets by rotating the rotating member, wherein when the first gear is rotated in the second direction by the drive source, the rotational force providing unit rotates the rotating member such that the movement unit separates the pickup roller from the sheets.

7. The feeding apparatus according to claim 6, further comprising:

a conveyance roller configured to convey the sheets fed by the pickup roller; and a differential unit configured to transmit a rotation of the driven gear to the conveyance roller, wherein the differential unit includes a plurality of transmission members to transmit drive that include an allowance and while the movement unit separates the pickup roller from the sheets, owing to the allowance the rotation of the driven gear is not transmitted to the conveyance roller.

8. An image forming apparatus, comprising:

the feeding apparatus according to claim 6; and an image forming unit configured to form an image on a sheet fed by the feeding apparatus.

9. An image reading apparatus, comprising:

the feeding apparatus according to claim 6; and an image reading unit configured to read an image formed on a sheet fed by the feeding apparatus.

10. A feeding apparatus, comprising:

a first gear that is driven by a drive source, wherein the first gear is rotated in a first direction and a second direction opposite to the first direction by the drive source;

a second gear;

a supporting member configured to support the second gear capable of revolving around the first gear in a rotatably engaged state with the first gear;

a driven gear engaging with the second gear when the second gear revolves to an engagement position due to the rotation of the first gear in the first direction;

a rotational force providing unit configured to provide a rotational force to the driven gear to rotate the first gear in the second direction via the second gear when the second gear is engaged with the driven gear;

a roller configured to feed a sheet; and a transmitting unit configured to transmit a rotation from the driven gear to the roller, wherein when the first gear is rotated in the second direction by the drive source, the second gear receives a rotational force via the driven gear and the rotational force prevents the second gear from revolving around the first gear.

* * * * *